US005475925A

United States Patent [19]

Newman et al.

[11] Patent Number: 5,475,925

[45] Date of Patent: Dec. 19, 1995

[54] THREE-PIECE RETRACTABLE-BLADED KNIFE

[76] Inventors: Philip H. Newman, 98 Rim Rd.; B. Michael Jackson, 3917 West Rd.; Charles T. Gregg, 1060 Los Pueblos; David Platts, 1932-B 42nd St., all of Los Alamos, N.M. 87544

[21] Appl. No.: 215,893

[22] Filed: Mar. 21, 1994

[51] Int. Cl.[6] ..... B26B 1/08

[52] U.S. Cl. ..... 30/162; 30/335; 30/339; 606/167; 606/181

[58] Field of Search ..... 30/162, 335, 339; 606/167, 181

[56] References Cited

U.S. PATENT DOCUMENTS

| | | | |
|---|---|---|---|
| 1,853,672 | 4/1932 | Dodson | 30/162 |
| 2,548,797 | 4/1951 | Ingwer et al. | 30/162 |
| 3,079,686 | 3/1963 | Christy | 30/162 |
| 3,192,624 | 7/1965 | Gringer | 30/162 |
| 3,863,339 | 2/1975 | Reaney et al. | 30/162 |
| 3,879,847 | 4/1975 | Roll | 30/335 |
| 3,906,626 | 9/1975 | Riuli | 30/335 |
| 4,170,062 | 10/1979 | Machida | 30/162 |
| 4,389,776 | 6/1983 | Okada | 30/162 |
| 4,558,517 | 12/1985 | Gringer | 30/162 |
| 5,201,748 | 4/1993 | Newman et al. | 30/355 |

*Primary Examiner*—Kenneth E. Peterson
*Attorney, Agent, or Firm*—Samuel M. Freund

[57] ABSTRACT

A three-piece knife having a replacable, retractable cutting blade, which may be locked either in the operating or deployed position, or in a retracted or safety position, by using a single digit on one hand, is described. Safety of hospital personnel and medical waste-disposal personnel is achieved in the surgical scalpel embodiment of the three-piece knife without loss of function or convenience of the scalpel.

1 Claim, 5 Drawing Sheets

THREE-PIECE RETRACTABLE-BLADED KNIFE

BACKGROUND OF THE INVENTION

The present invention relates generally to cutting instruments, and more particularly to surgical scalpels and other knives having retractable blades.

It is well known that existing surgical cutting implements provide a significant potential for harm to surgeons and support personnel. That is, with attention directed toward the patient, rapid handling of surgical instruments with exposed sharp edges occasionally leads to cuts and puncture wounds, and more often to loss of integrity of surgical gloves. With increasing risk of life-threatening infectious diseases, it is imperative that such risks be minimized.

Utility knives having retractable blades are well known. Of the manually-operated (as opposed to spring-actuated) variety, there appear to be five types. A screw-type of locking mechanism is described in U.S. Pat. No. 2,735,176 for "Veterinary Surgical Knife," which issued to William J. Costin on May 22, 1953. A surgical knife, which includes a hollow ground blade of surgical steel and a hollow handle into which the blade can be fully retracted for protection while the blade is not in use and from which the edged portion of the blade can be projected for use with the blade disposed substantially in longitudinal alignment with the handle, is illustrated. The locking mechanism taught includes a threaded pin attached to the blade which extends through a slot in the handle, and a knob which is threaded onto the pin for locking the blade in either an extended or withdrawn position. Two hands are required for successful operation of the Costin invention.

Surgical scalpels having protective sheaths, which are secured to the scalpel handle when the scalpel is in use, but slidable over the blade when the scalpel is not required, are described in U.S. Pat. No. 3,905,626, for "Disposable Surgical Scalpel," which issued to Arduino Riuli on Sep. 23, 1975, and in German Patent P 3722-899-4, for "Skalpell," which issued to T. Peters on Jan. 19, 1989.

Rectractable-bladed knives having leaf-spring loaded operating buttons attached to a slide which bears the cutting blade, and which engage notches in the knife handle when released by the operator, are described in U.S. Pat. No. 1,853,572 for "Pocket Knife," which issued to A. F. Dodson on Apr. 12, 1932, in U.S. Pat. No. 3,079,686 for "Handle Construction For Sliding Blade Knives," which issued to E. B. Christy on Mar. 5, 1953, and in U.S. Pat. No. 3,863,339 for "Retractable Blade Knife," which issued to Albert Reaney et al. on Feb. 4, 1975.

A variation on this design is where the leaf-spring formed from the knife blade slider itself, as described in U.S. Pat. No. 4,089,112, for "Adjustable Blade Knife," which issued to James L. Richards on May 16, 1978, and in U.S. Pat. No. 4,884,307 for "Pocket Tool," which issued to Ralph Flood On Dec. 5, 1989.

In U.S. Pat. No. 3,879,847 for "Cutter With Forwardly And Rearwardly Displaceable Blade," which issued to Dieter Roll on Apr. 29, 1975, in U.S. Pat. No. 4,200,977 for "Cutter Knife," which issued to Toshihiko Kageyama et al. on May 6, 1980, and in U.S. Pat. No. 4,233,734 for "Retractable Blade Knife," which issued to Sylvester. W. Bles on Nov. 18 1980, cutting knives having operating members for locating the blade at any desired position outside of a hollowed handle portion adapted for shielding the blade when not in use, and means for securing the operating members at desired positions with respect to the handle portion by utilizing a series of engagement surfaces formed in the handle portion and located in a plane extending in a direction substantially perpendicular to the direction of movement of the operating member and a catch formed in the operating member, which releasible engages one of the engagement surfaces when the desired blade position is attained. In these inventions, a resilient, deformable operating member is employed in order to achieve the releasable engagement between the engagement surfaces of the handle and the catch in the operating member. Blade slides are designed and fabricated to accommodate the particular operating members and locking mechanisms employed, the blades themselves being attached to the blade slides, and handle portions are fabricated from more than one part in order to receive the complex operating members and blade slides, Accordingly, it is an object of the present invention to provide surgical scalpels and other knives having retractable blades which may be locked in either a deployed or a retracted position, Another object of our invention is to provide surgical scalpels and other knives having retractable blades which may be locked in either a deployed or a retracted position and which may be operated using one digit of one hand.

Yet another object of the invention is to provide surgical scalpels and other knives having retractable blades which may be locked in either a deployed or retracted position, but which cannot accidentally be deployed.

Still another object of our invention is to provide surgical scalpels and other knives having retractable blades for which standard, commercially-available blades are employed, and which have only three parts.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out, in the appended claims.

SUMMARY OF THE INVENTION

To achieve the foregoing and other objects and in accordance with the purpose of the present invention, as embodied and broadly described herein, the retractable-bladed knife hereof includes a generally flat, solid, elongated handle member having a forward end and a rearward end, the handle member having a longitudinal rectangular channel in one side of the handle member opening at the forward end thereof and extending rearward toward, but not reaching the rearward end thereof, there being two pairs of opposing tabs located within the channel near the surface of the side of the handle member in which the channel is placed, and further having a longitudinal groove in the base of the rectangular channel ending in the vicinity of the forward end thereof; a flat cutting blade having a longitudinal slot therein; and a resilient bow-shaped, elongated slide member adapted to slidably move through the rectangular channel in the handle member, the slide member having a convex upper portion and a concave lower portion, the convex and concave curvature therein being generally perpendicular to the longitudinal axis of thereof, the slide member further having two tabs disposed perpendicularly to the concave portion, one tab being located in the vicinity of the forward end thereof and the second tab located in the vicinity of the rearward end thereof, the tabs being adapted to engage and protrude through the longitudinal slot in the cutting blade and slide in the longitudinal groove of the handle member, a digit-engaging region and two recesses being located in the convex upper portion of the slide member, the recesses being adapted to engage one of the two pairs of opposing tabs in the handle member when located thereunder; whereby, when the slide member is depressed by the action of a users digit on the digit-engaging portion, the slide member is flattened, thereby releasing the locking action of the recesses therein engaging one pair of tabs, and the slide member may be moved forward or rearward in the channel to the second pair of tabs, where, once the action of the user's digit is withdrawn, the slide member will reversibly engage the remaining pair of tabs and the cutting blade will be reversibly locked in the deployed or retracted position, respectively.

Preferably, the handle member has one longitudinally-disposed slot through the side thereof opposite the side in which the channel is placed directly opposite to and substantially coextensive with each tab, as an aid in the fabrication of the handle by molding or machining techniques.

It is also preferred that the handle member be available in several shapes and sizes other than the standard surgical scalpel design; in particular, a flat "teardrop" shape is known to have advantages in certain surgical procedures.

Benefits and advantages of the present invention include simple and inexpensive fabrication and assembly resulting from the simple, three-piece design.

BRIEF DESCRIPTION OF THE DRAWINGS

The accompanying drawings, which are incorporated in and forms a part of the specification, illustrate two embodiments of the present invention and, together with the description, serve to explain the principles of the invention.

DETAILED DESCRIPTION OF THE PREFERRED EMBODIMENTS OF THE INVENTION

Briefly, the present invention includes a three-piece cutting knife having a retractable blade which may be locked in either the operating or deployed position, or in a retracted or safety position, using a single digit on one hand.

Reference will now be made in detail to the present preferred embodiments of the invention, an example of which is illustrated in the accompanying drawings. Identical or similar structure is identified by the same callouts.

Figure 1:
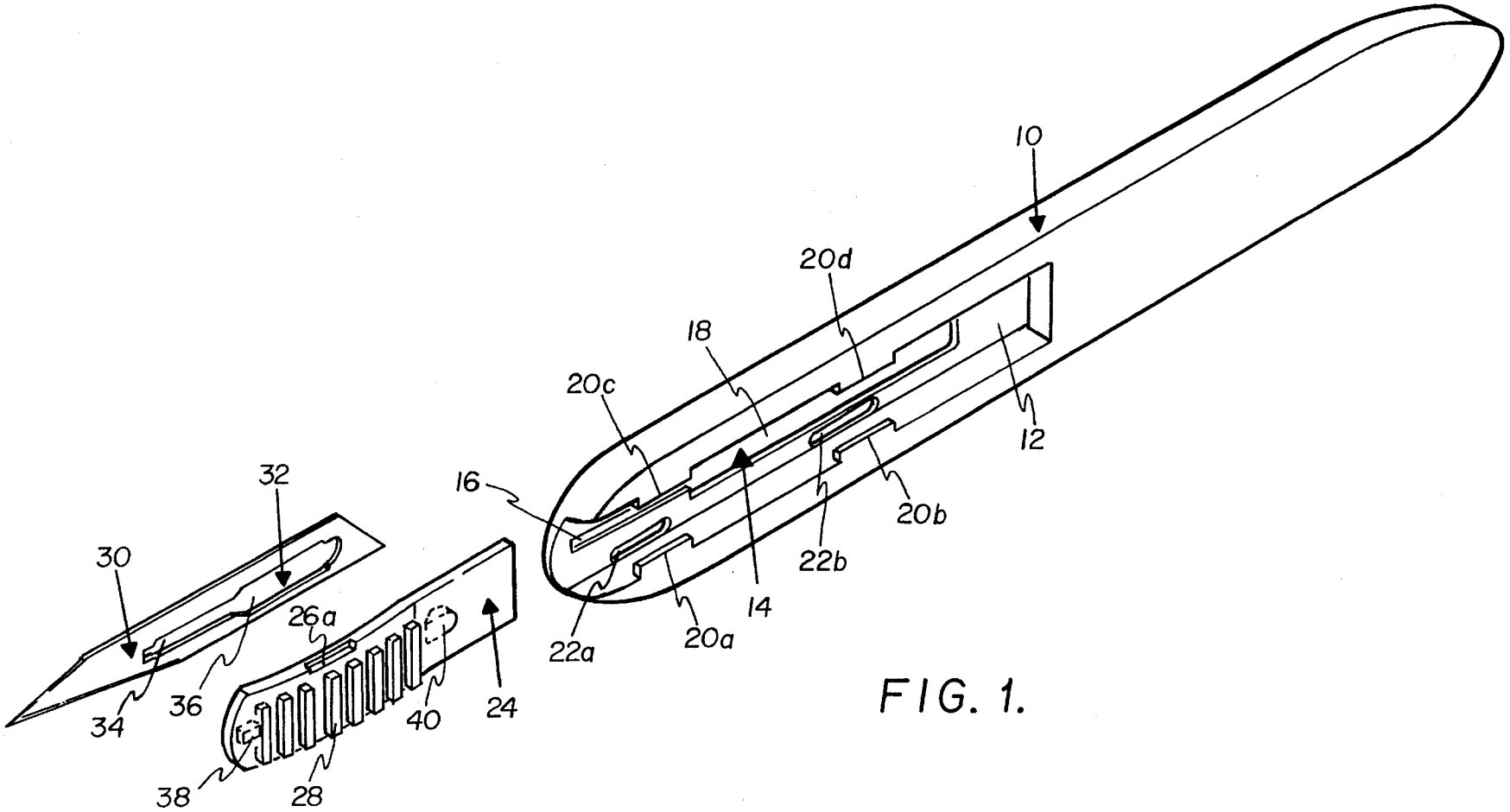
FIG. 1 shows a schematic representation of the retractable-bladed knife of the present invention illustrating the three parts thereof.

FIG. 1 shows a schematic representation of the retractable-bladed knife of the present invention illustrating the three parts thereof. Handle member 10 is generally flat and elongated, in the embodiment thereof suitable for surgical procedures, among other uses. Channel 12 is fashioned in one side thereof and opens at the front of the handle. Groove 14 is placed in the bottom of the channel and has a forward portion 16 and a rear portion 18. Groove 14 does not pierce the rear wall of the handle. Tabs 20*a–d* extend into channel 12 in opposing pairs. Slots 22 (22*a* and 22*b* shown in FIG. 1) are fashioned in the rear wall of handle 10 as an aid in the fabrication thereof; in particular, tabs 20*a–d* may be readily fabricated in handle member 10 by either, machining part of channel 12 through these slots, or by molding the handle as one piece with protrusions in the mold defining these tabs from the rear. Resilient , bow-shaped slide member 24 is adapted to slidably move in channel 12 under tabs 20*a–d*. Recesses 26 (recess 26*a* being shown in FIG. 1) are adapted to engage tabs 20 in the handle. Digit-engaging portion 28 on the convex side of slide 24 enables the slide to be readily moved by a digit of the operator of the knife. Surgical blade 30 shown in FIG. 1 is a standard-design blade having a longitudinal slot 32 therein which includes a narrow forward portion 34 and a wider, rear portion 36. Slider 24 has tabs 38 and 40 on the concave side thereof, tabs 38 and 40 being adapted to engage blade 32 through slots 34 and 36, respectively. Choice of materials of construction and size and shape of elements 10, 24, and 30 clearly depend on the intended use of the knife.

Figures 2A, 2B, 2C:
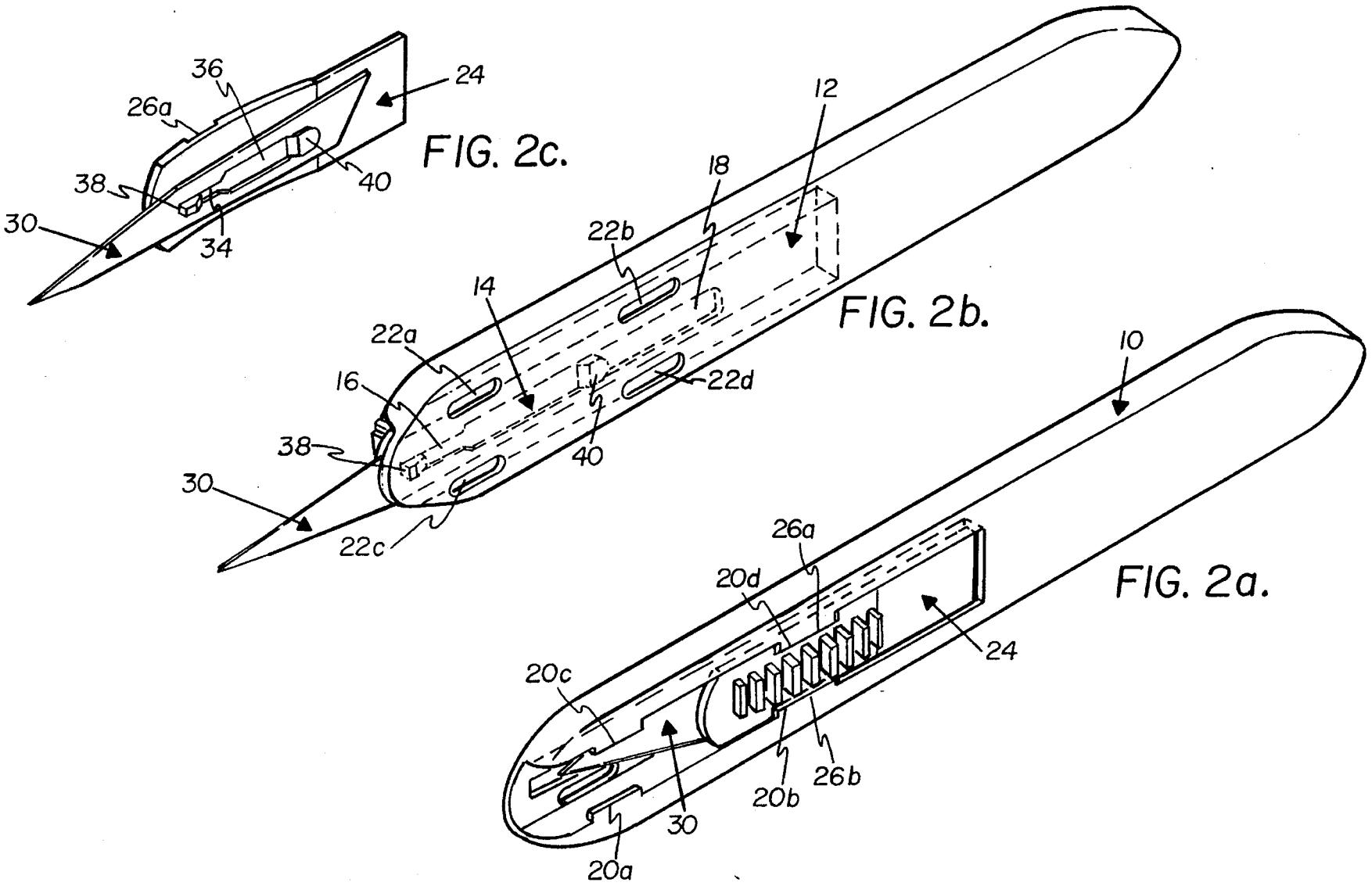
FIG. 2*a* shows a schematic representation of a perspective front view of the subject knife in its closed, locked position.
FIG. 2*b* shows a schematic representation of a perspective back view of the cutting knife of the present invention in its open, locked position.
FIG. 2*c* shows a schematic representation of a perspective bottom view of the slide member and cutting blade as they cooperate.

FIG. 2*a* shows a schematic representation of a perspective front view of the subject knife in its closed, locked position. Therein, recesses 26*a* and 26*b* reversible engage rear tabs 20*b* and 20*d* of handle 10, respectively. To move blade 30 forward to its deployed position, slide member 24 is depressed by applying pressure on digit-engaging portion 28, which releases the locking action of rear tabs 20*b* and 20*d* on recesses 26*a* and 26*b*, and moved forward in channel 12 to where recesses 26*a* and 26*b* are under front tabs 20*a* and 20*c*, respectively, and the pressure released from digit-engaging portion 28. The knife is thereby locked in its deployed condition. FIG. 2*b* shows a schematic representation of a perspective back view of the cutting knife of the present invention in its open, locked position. Shown is that tabs 38 and 40 in slide member 24 slide in groove 14 in handle 10. Since slot 32 in blade 30 is smaller toward the forward end thereof, 34, tab 38 is smaller than tab 40 in slide member 24. By fabricating forward groove portion 16 to be smaller than groove portion 18 of handle 10, blade 30 is laterally stabilized in the open position. Moreover, since groove portion 16 terminates before reaching the open end of channel 12, blade 30 and slide 24 cannot readily be moved or fall out of handle 10. FIG. 2*c* shows a schematic representation of a perspective bottom view of slide member 24 and cutting blade 30 as they cooperate. Tabs 38 and 40 engage narrow portion 34 and wide portion 36 of slot 32 in blade 30, respectively. It should be mentioned that it is not required that blade 30 be bonded to slide member. 24, thereby increasing the simplicity of fabrication and assembly of the present invention.

Figure 3A:
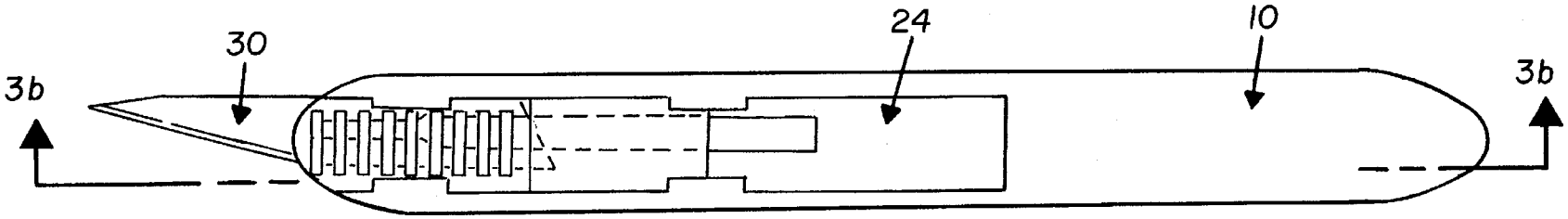
FIGS. 3*a–c* respectively show schematic representations of the side front, bottom, and side back views of the retractable-bladed knife in its open position.
Figure 3B:
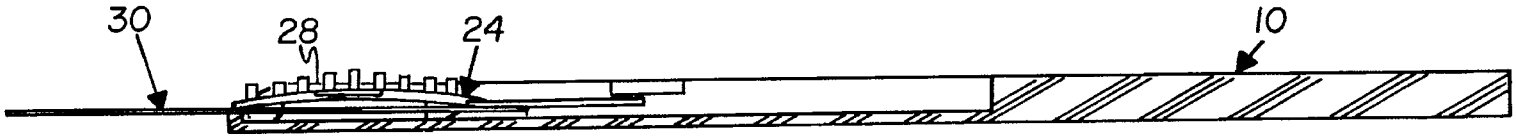
Figure 3C:
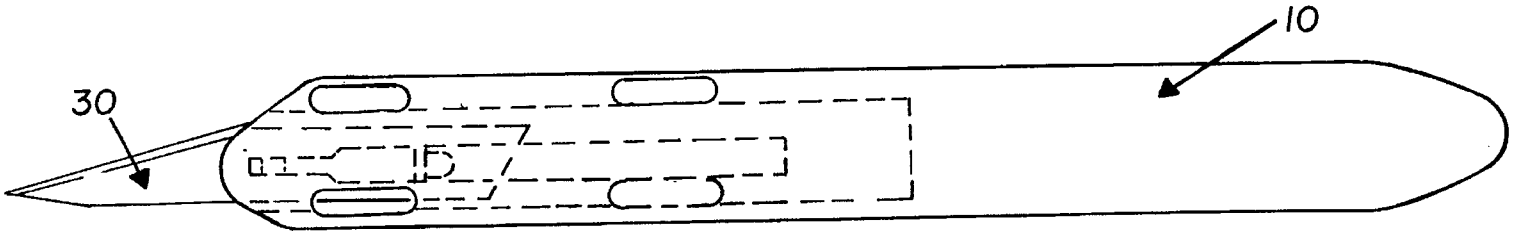

FIGS. 3*a–c* respectively show schematic representations of the side front, bottom, and side back views of the retractable-bladed knife in its open position. In particular, FIG. 3*b* illustrates the bowed aspect of slide member 24, the digit-engaging portion 28 being located on the convex side thereof.

Figure 4A:
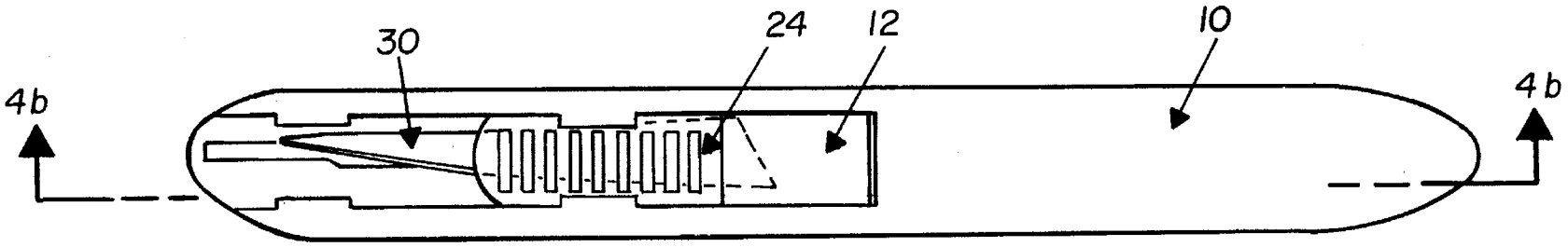
FIGS. 4*a–c* respectively show schematic representations of the side front, bottom, and side back views of the retractable-bladed knife in its closed position.
Figure 4B:
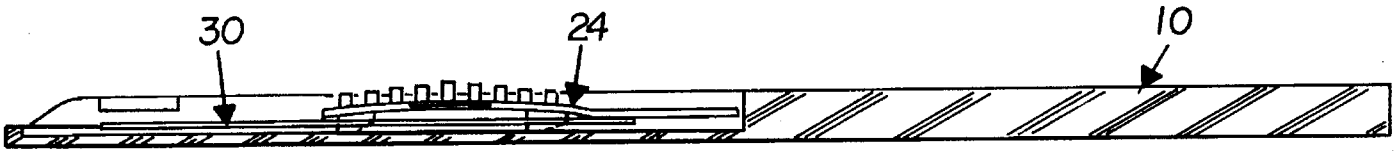
Figure 4C:
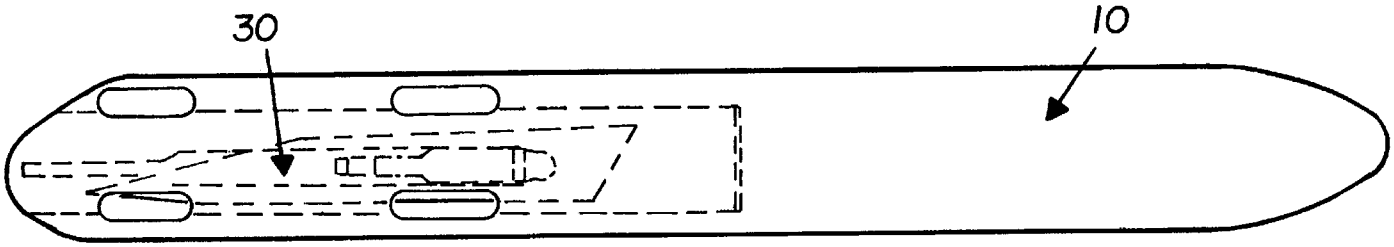

FIGS. 4*a–c* respectively show schematic representations of the side front, bottom, and side back views of the retractable-bladed knife in its closed position.

Figure 5:
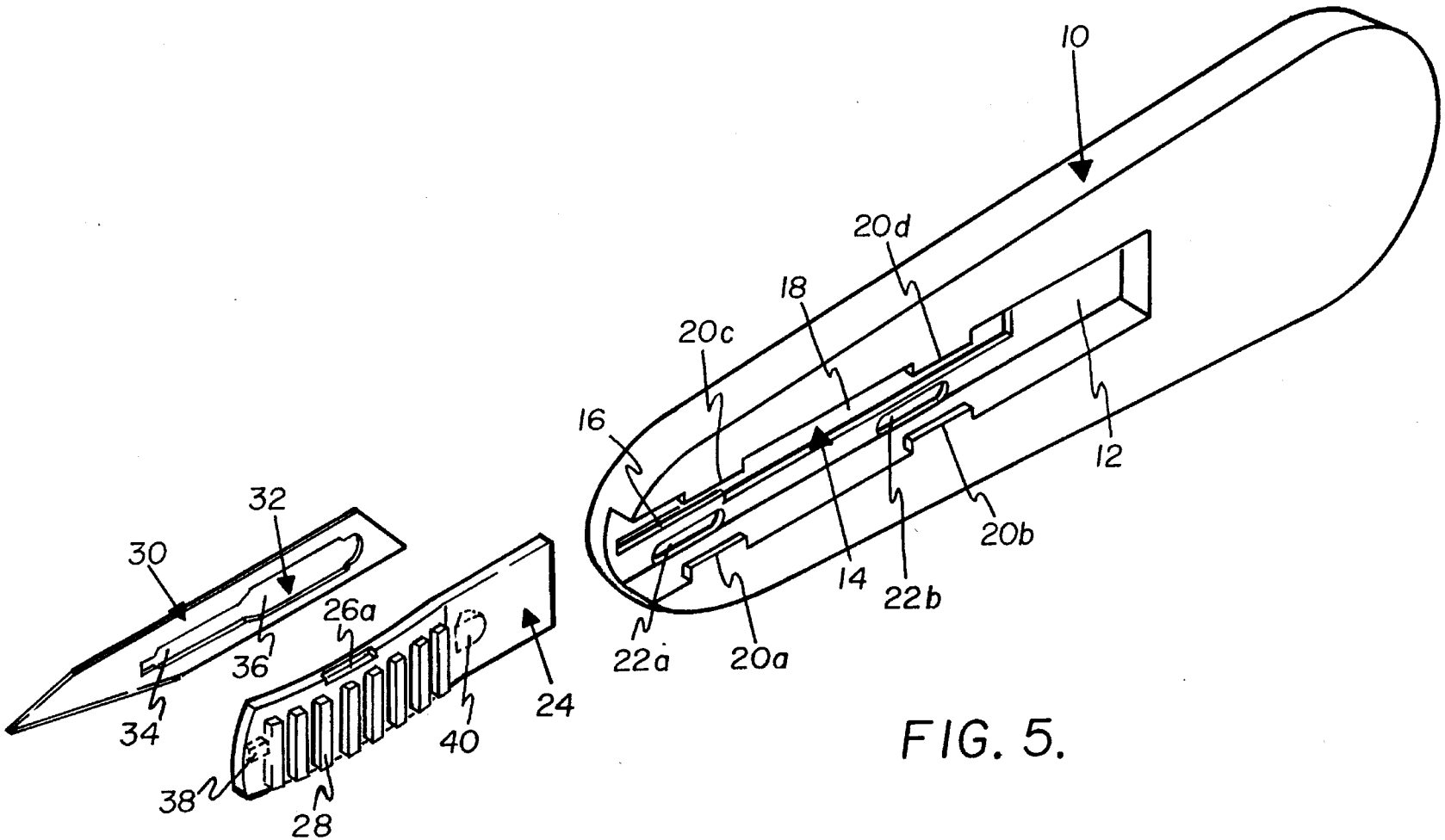
FIG. 5 shows a schematic representation of a second embodiment of the retractable-bladed knife of the present invention illustrating the three parts thereof, the embodiment differing from that shown in FIG. 1 hereof in the shape of the handle member.

FIG. 5 shows a schematic representation of a second embodiment of the retractable-bladed knife of the present invention illustrating the three parts thereof, the embodiment differing from that shown in FIG. 1 hereof in the shape of the handle member.

The foregoing description of two preferred embodiments of the invention have been presented for purposes of illustration and description. It is not intended to be exhaustive or to limit the invention to the precise form disclosed, and obviously many modifications and variations are possible in light of the above teaching. For example, it would be apparent to one having skill in the surgical arts, after carefully studying the present disclosure, that various handle shapes and sizes and numerous cutting blade designs may be utilized in the present invention. Additionally, choice of materials would depend on the intended use; for example, biocompatible and sterilizer materials would be utilized for surgical instrument embodiments of the invention. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What we claim is:

1. A three-piece knife having a retractable blade, comprising in combination:

a. a generally flat, solid, elongated handle member having a forward end and a rearward end, said handle member having a longitudinal rectangular channel in one side surface of said handle member opening at the forward end thereof and extending rearward toward, but not reaching the rearward end thereof, there being two pairs of opposing tabs located within the channel in proximity to the surface of the side of said handle member in which the channel is placed, and further having a longitudinal groove in a base of the rectangular channel ending in the vicinity of a forward end of said handle member;

b. a flat cutting blade having a longitudinal slot therein; and c. a resilient bow-shaped, elongated slide member adapted to slidably move through the rectangular channel in said handle member, said slide member having a convex upper portion and a concave lower portion, a forward end and a rearward end, the convex and concave curvature therein being generally perpendicular to a longitudinal axis of said slide member, said slide member further having two tabs disposed perpendicularly to the concave portion, one tab being located in a vicinity of the forward end thereof and the second tab located in the vicinity of a rearward end thereof, the tabs being adapted to engage and protrude through the longitudinal slot in said cutting blade and slide in the longitudinal groove of said handle member, a digit-engaging region and two recesses being located in the convex upper portion of said slide member, the recesses being adapted to engage one pair of the two pairs of opposing tabs in said handle member when located thereunder; whereby, when said slide member is depressed by an action of a user's digit on the digit-engaging portion, said slide member is flattened, thereby releasing the locking action of the recesses therein engaging one pair of on of the recesses therein engaging one pair of tabs, and said slide member may be moved forward or rearward in the channel to the other pair of tabs, where, once the action of the user's digit is withdrawn, said slide member will reversibly engage the other pair of tabs and said cutting blade will be reversibly locked in the deployed or retracted position, respectively.

* * * * *